US006029741A

United States Patent [19]

Yokogi et al.

[11] Patent Number: 6,029,741

[45] Date of Patent: Feb. 29, 2000

[54] HEATING APPARATUS FOR A GAS CONTAINER

[75] Inventors: Kazuo Yokogi; Yoshihiro Sano, both of Hyogo-ken, Japan

[73] Assignee: L'Air Liquide, Societe Anonyme pour l'Etude et l'Exploitation des Procedes Georges Claude, Paris, France

[21] Appl. No.: 09/201,768

[22] Filed: Dec. 1, 1998

[30] Foreign Application Priority Data

Dec. 2, 1997 [JP] Japan ..... 9-332221

[51] Int. Cl.[7] ..... F28F 9/22

[52] U.S. Cl. ..... 165/80.1; 126/261

[58] Field of Search ..... 62/48.1, 48.4; 126/261, 262; 165/80.1

[56] References Cited

U.S. PATENT DOCUMENTS

| | | | |
|---|---|---|---|
| 2,010,316 | 8/1935 | O'Gorman | 126/261 |
| 2,595,685 | 5/1952 | Mallory | 165/120 |
| 3,246,690 | 4/1966 | Fry | 165/80.1 X |
| 4,163,471 | 8/1979 | Leder | 165/80.5 |
| 4,722,322 | 2/1988 | Varney et al. | 126/261 |
| 5,375,423 | 12/1994 | Delatte | 62/45.1 |
| 5,699,669 | 12/1997 | Gebhard | 165/80.1 X |

FOREIGN PATENT DOCUMENTS

| | | | |
|---|---|---|---|
| 553586 | 4/1931 | Germany | 165/80.1 |

*Primary Examiner*—Allen Flanigan
*Attorney, Agent, or Firm*—Burns, Doane, Swecker & Mathis, LLP

[57] ABSTRACT

The present invention provides a heating apparatus for effectively heating a gas container, and more particularly a liquified gas filled in the gas container. The heating apparatus comprises a mounting base having a first space and a second space, each formed in its inside, and an air fan heater for supplying heated air to the first space of said mounting base. In said mounting base, a first through hole communicating with said first space and second through holes communicating with said second space are formed inside of a mounting area, and third through holes communicating with said second space are formed outside of said mounting area. When a gas container is mounted on the mounting base, the heated air is blasted from said first space onto the bottom face of said gas container through said first through hole, whereby heat is effectively transmitted from the bottom face of the gas container to the liquified gas contents of the gas container.

3 Claims, 4 Drawing Sheets

HEATING APPARATUS FOR A GAS CONTAINER

BACKGROUND OF THE INVENTION

1. Field of the Invention

The present invention relates to a heating apparatus for heating a gas container filled with a liquified gas.

2. Description of the Prior Art

In the semiconductor-manufacturing industry, $NH_3$, $SiH_2Cl_2$, $BCl_3$ and $WF_6$ gases are used as a material gas. Each of these gases is usually stored as a liquified gas in a portable gas container which is called a gas cylinder or gas bomb. Such a gas is optionally supplied as an evaporated gas to gas consumers, as it evaporates in the gas container. However, unless sufficient heat corresponding to the heat of vaporization is supplied from the outside of a gas container to effect evaporation of the liquified gas, particularly when supplying gas from a gas container of liquified gas, the temperature of said liquified gas will drop over time as it is being used. If the temperature of a liquified gas drops, the pressure of its saturated vapor also lowers with the temperature drop. Thus, the supply of the liquified gas becomes ultimately impossible, because of a shortage of supply pressure.

Accordingly, the industry has adopted a method of using liquified gas while the flow rate of said gas, as supplied from one gas container, is limited. Alternatively, a heating apparatus is attached to the gas container so that a supplement of heat is provided to the liquified gas when it is desired to supply such gas over a limited flow rate. In general, the heating apparatus of the prior art is composed of a drum-shaped water jacket surrounding the side wall of a gas container and a warm water circulator for causing warm water, which is the heating source, to flow through this water jacket.

The aforedescribed conventional heating apparatus serves to transmit heat to the inside of a gas container by way of its side wall. In this method, however, there is a great waste of energy in transmitting heat not only to the liquified gas, but also to the gas existing above the liquified gas (the gas phase portion). When heating from the side, there is the additional problem that the thermal efficiency is low because the convection generated in the liquified gas is local.

Moreover, the warm water circulator used in the heating apparatus of the prior art is large in size, and hence a great deal of labor is needed for the handling, maintenance and management of the circulator.

It is therefore an object of the present invention to provide a heating apparatus for a gas container which avoids the aforedescribed problems of the prior art.

SUMMARY OF THE INVENTION

In accordance with the foregoing objective, the present invention provides a heating apparatus comprising a mounting base having a mounting area on which a gas container is to be mounted, and a first space and a second space, each formed within the mounting base, and each independent of the other. The mounting base also comprises a first through hole communicating with said first space and second through holes communicating with said second space, the first and second holes being inside of said mounting area, and third through holes communicating with said second space outside of said mounting area. The apparatus also comprises a heated air supply means for supplying heated air to said first space of said mounting base.

When a gas container is mounted in the mounting area of said mounting base, heated air sent from the heated air supply means is blasted from said first space onto the bottom face of said gas container through the first through hole. Since said gas container is a pressure vessel and its bottom face is generally shaped in a semi-spherical form, heat from the heated air will be effectively transmitted from the bottom face of the gas container to the liquified gas. Thereafter, the heated air is sent from a space surrounded by the bottom face of the gas container and the top face of the mounting base into said second space through said second through holes, and again led out of said third through holes to the outside of said mounting base.

Where the air from the third through hole is heated, it is most effective that said air is caused to flow along the outer face of the side wall of the gas container to transmit heat from the side wall of the gas container to the liquiefied gas. Therefore, it is preferred that an enclosure is provided which surrounds the outer face of the side wall of the gas container mounted in said mounting area, with a gap held between them, where heated air led out of the third through holes is supplied to said gap.

DETAILED DESCRIPTION OF THE PREFERRED EMBODIMENTS

Figure 1:
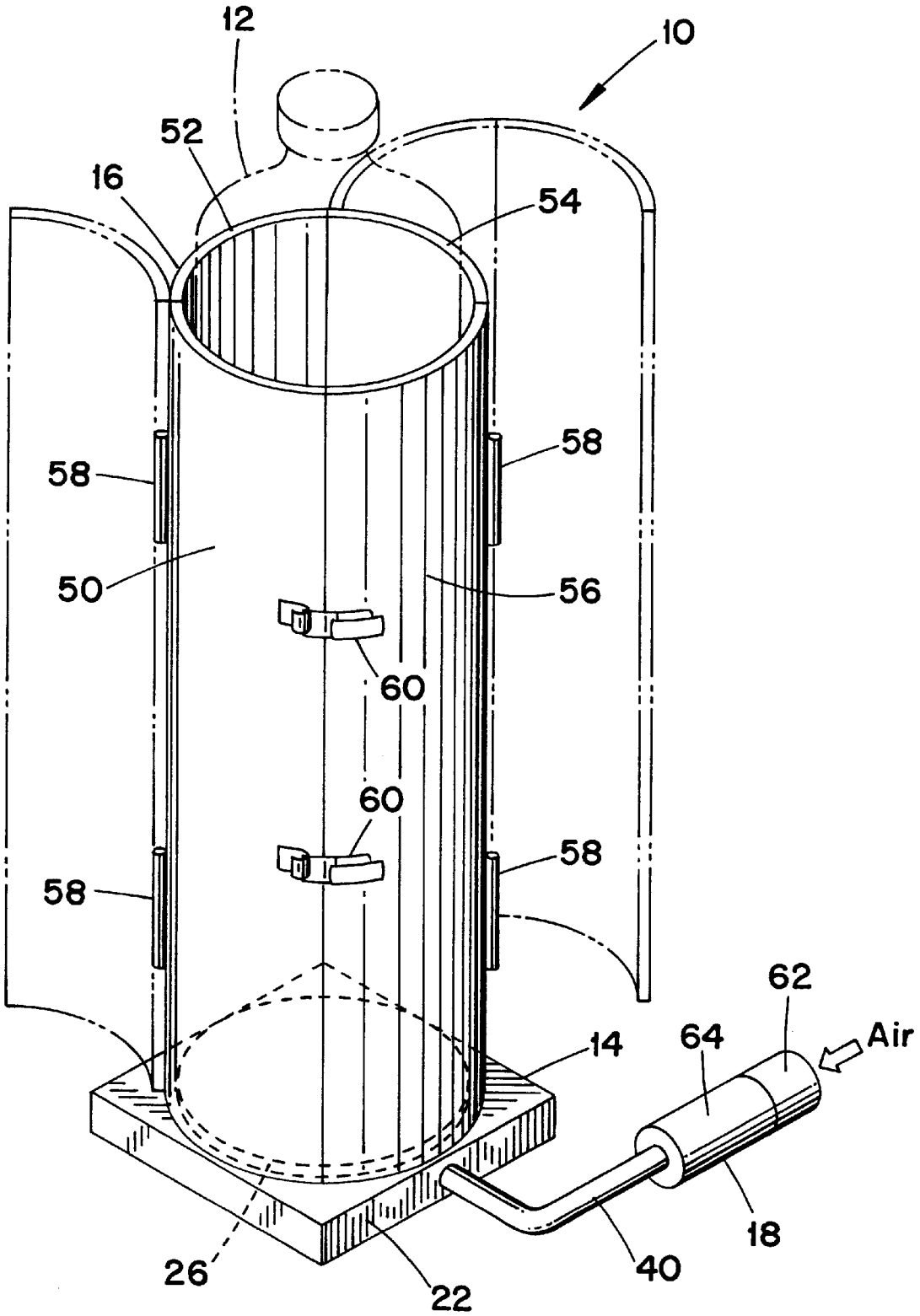
FIG. 1 is a perspective view showing one embodiment of a heating apparatus according to the present invention.

Referring to the figures of the drawing, the preferred embodiments of the present invention will be described in detail. In all the figures of the drawing, the same numeral is assigned to the same or corresponding item. More specifically, the following consistent reference numbers have been used:

10—heating apparatus, 12—gas container, 14—mounting base, 16—enclosure, 18—air fan heater (a heated air supply means), 34—first space, 36—second space, 42—first through hole, 44—mounting area, 46—second through holes, 48—third through hole, 68—gap.

FIG. 1 is a perspective view showing a heating apparatus 10 according to the present invention. The illustrated heating apparatus 10 essentially comprises a mounting base 14, on which a gas container 12 is to be mounted, an enclosure 16 attached on said mounting base 14 so as to surround the gas container 12, and an air fan heater (a heated air supply means) 18 for supplying heated air to the mounting base 14.

Figure 2:
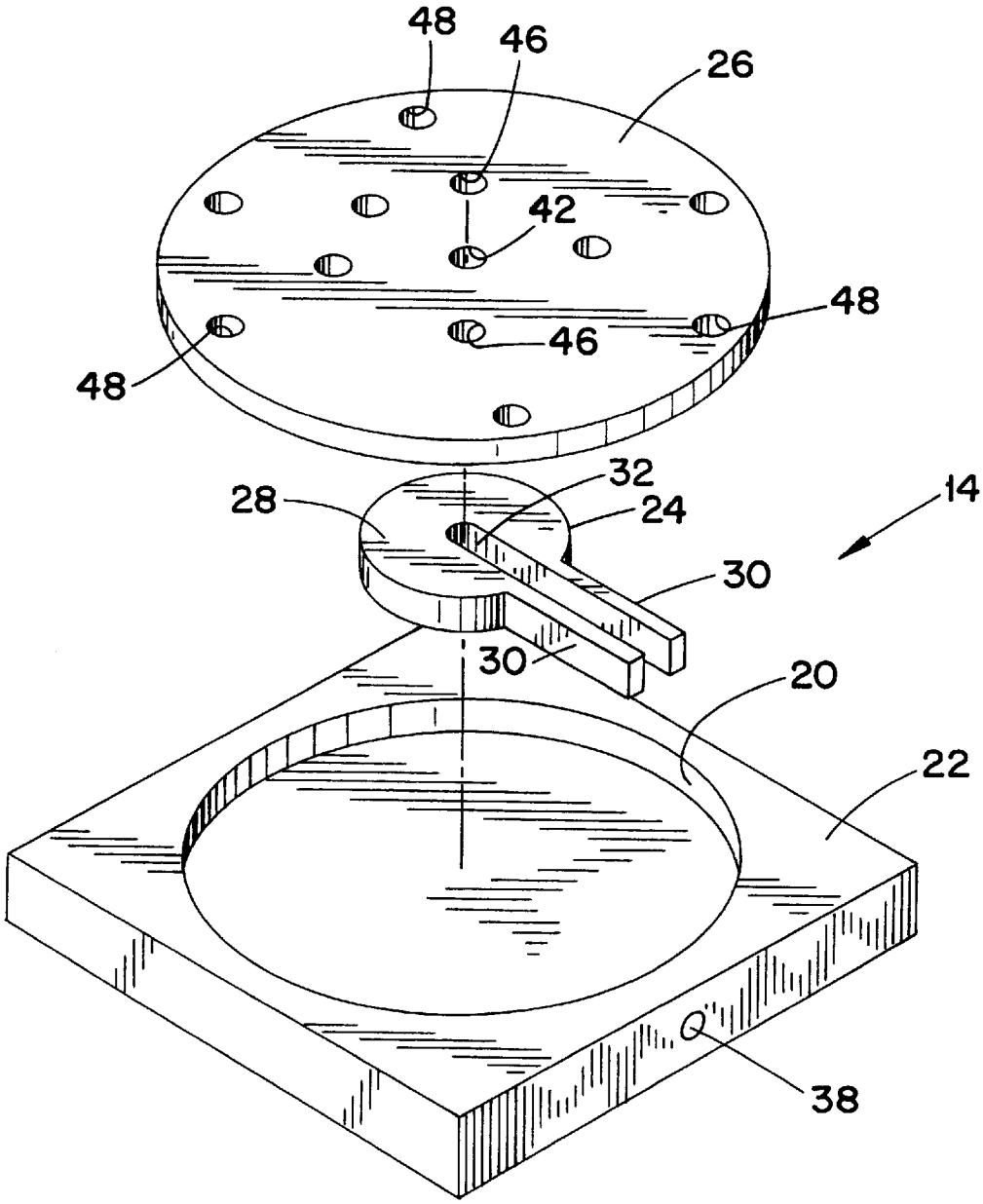
FIG. 2 is an exploded perspective view showing a mounting base in the heating apparatus shown in FIG. 1.
Figure 3:
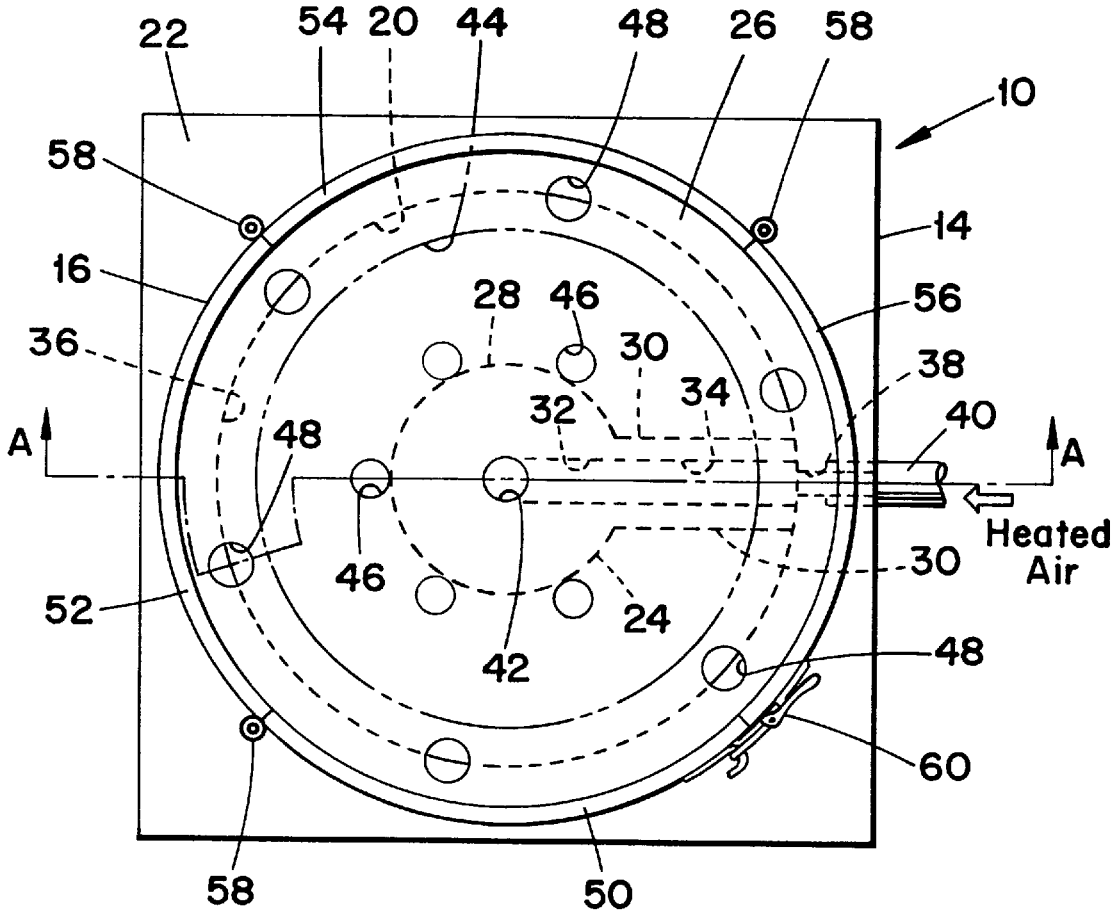
FIG. 3 is a plan view of the heating apparatus shown in FIG. 1.
Figure 4:
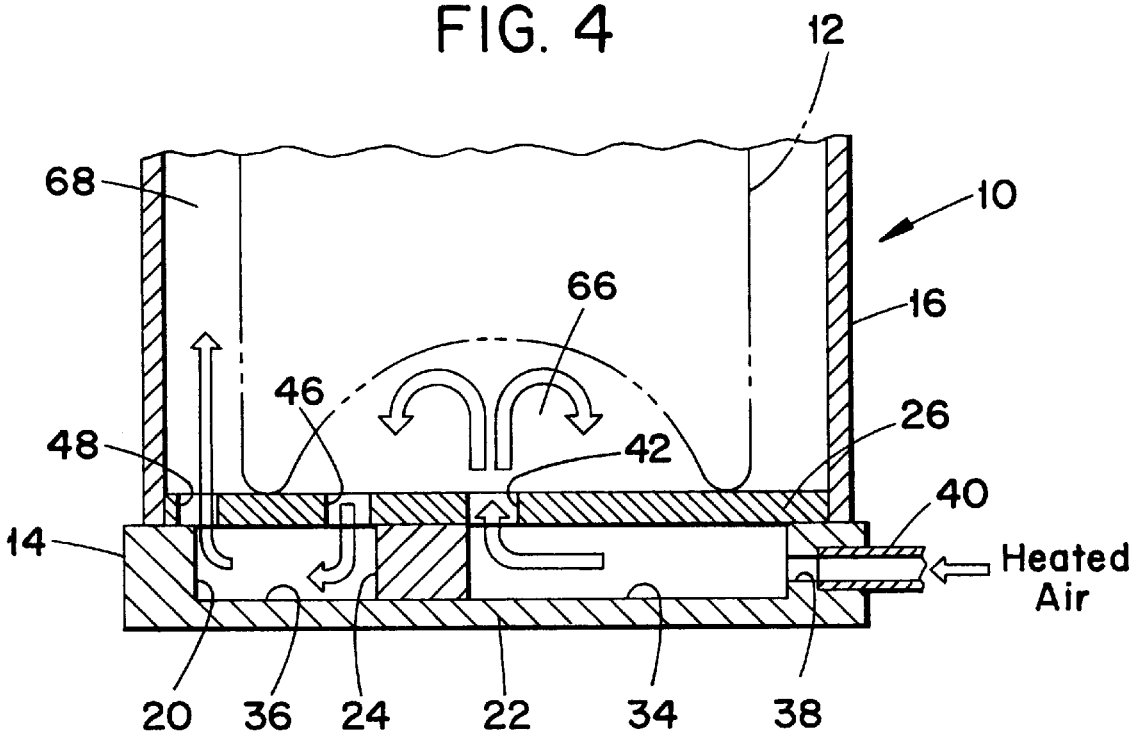
FIG. 4 is a cross-sectional view taken along the line A—A of FIG. 3, showing the lower portion of the heating apparatus.

As clearly shown in FIG. 2 to FIG. 4, the mounting base 14 comprises a bottom plate 22 having a circular concavity 20 formed therein, an intermediate member 24 disposed in the concavity 20 of said bottom plate 22, and a circular top plate 26 disposed and fixed on the top face of said bottom plate 22 so as to cover said concavity 20. Although not illustrated, these component elements are mutually assembled by proper tightening means such as bolts, nuts, rivets or an adhesive.

The intermediate member 24 comprises a disc portion 28 disposed concentrically with the concavity 20 and a pair of flat plate portions 30, 30 extending in parallel with each other outwards from the outerperipheral face of this disc portion 28. The disc portion 28 has a notch 32 formed so as to extend to the center thereof, and this notch 32 is arranged in a straight line along a gap between the flat plate portions 30, 30. In the completed assembly of the mounting base, as shown in FIG. 4, the top face and bottom face of said intermediate member 24 are respectively in contact with the bottom face of said top plate 26 and the bottom face of the concavity 20 of said bottom plate 22, and the end faces of the flat plate portions 30, 30 are in contact with the inner-peripheral face of said concavity 20. In the concavity 20, as a result, there are formed a first space 34 positioned inside of the intermediate portion 24 and a second space 36 positioned outside thereof.

In one side of said bottom plate 22 is formed a through hole 38 extending to the inner-peripheral face of said concavity 20 so as to communicate with the first space 34. To this through hole 38 will be connected a pipe 40 coming from the fan heater 18.

In FIG. 3, it can be seen that the top plate 26 is disposed concentrically with the concavity 20 and with the circular portion 28 of said intermediate member 24. At the center of the top plate 26 is formed a through hole (a first through hole) 42. This through hole 42 is made to communicate with the first space 34 formed in the circular portion 28 of the intermediate member 24.

The central area of the top face of said top plate 26 is a mounting area 44, on which the gas container 12 is to be mounted, and its boundary is shown by a two-dot chain line in FIG. 3. The diameter of this mounting area 44 corresponds to the maximum outer diameter of the gas container 12 to be used. Within this mounting area 44, a plurality of through holes (second through holes) 46 are formed in the top plate 26. These through -holes 46 are disposed equidistantly from the through hole 42 at the center, and that distance is somewhat longer than the radius of the circular portion 28 of said intermediate member 24. Thus, these through holes 46 are in communication with the second space 36 in the mounting base 14. In the top plate 26, furthermore, a plurality of through holes (third through holes) 48 communicating with the second space 36 are formed within a portion outside of the mounting area 44. These through holes 48 are also disposed equidistantly from the through hole 42, and they will be preferably disposed mutually equidistantly in the circumferential direction.

Although not illustrated, some reinforcement members for reinforcing and supporting the top plate 26 will be preferably disposed within the second space 36.

The enclosure 16 is a cylinder made of a metal sheet. Since the inner diameter of the illustrated enclosure 16 is almost equal to the outer diameter of the top plate 26 of the mounting base 14, the enclosure 16 is positioned along the profits of the outerperipheral face of the top plate 26. This enclosure 16 is divided into four parts in the circumferential direction, where a first portion 50 and a second portion 52, the second portion 52 and a third portion 54, and the third portion 54 and a fourth portion 56 are hinged with each other, respectively. The lower end of the second portion 52 is fixed on the top face of the bottom plate 22, as the inner face thereof is abutted with the outer-peripheral face of the top plate 26 of the mounting base 14. In such a construction, the first portion 50, the third portion 54 and the fourth portion 56 of said enclosure 16 can be opened or closed with hinges 58 on both the sides of the second portion 52 thereof as a center, and hence the gas container 12 can be mounted from the side onto the mounting base 14. After the gas container 12 has been mounted thereon, the first portion 50 and the fourth portion 56 are satisfactorily tightened by a proper locking means 60, as the enclosure 16 is made cylindrical.

The air fan heater 18 has a conventional structure comprised of an air fan 62 for sending air and an electric resistance heater 64 for heating the air from said air fan 62.

In the aforementioned construction, the operation of the heating apparatus 10 according to the present invention will be described in greater detail.

At first, a gas container 12 is properly mounted on the mounting area 44 of said mounting base 14. After the enclosure 16 is closed, the air fan heater 18 is operated to introduce heated air having a higher temperature into the first space 34 within the mounting base 14 through the pipe 40. Since the bottom face of the gas container 12 is made semi-spherically concave, as roughly shown by the two-dot chain line in FIG. 4, a space 66 is formed between this concavity and the top plate 26 of the mounting base 14. Accordingly, the heated air introduced in the first space 34 is caused to come into said space 66 through said through hole 42. The heat from the heated air introduced into the space 66 is transmitted from the whole of the bottom face of said gas container 12 to the contents, i.e., a liquified gas, in the gas container 12. In such a case where heat is provided from the lower side, a large convection is generated in the liquified gas, whereby heat will be effectively transmitted to the whole of the liquified gas.

Referring to FIG. 6, the heated air which has transferred heat to the bottom face of the gas container 12 is sent from the space 66 to the second space 36 in the mounting base 14 through the through holes 46. Then, this heated air is introduced into an annular gap 68 formed between the enclosure 16 and the gas container 12 through the through holes on the outerperipheral portion. By properly regulating the flow rate of the heated air or an initial temperature given by the air fan heater 18, the temperature of the heated air which has provided heat to the bottom of the gas container 12 can be made higher than ambient temperature. Thus, when the heated air is caused to flow inside enclosure 16, the thermal energy remaining in the heated air is transmitted from the side wall of the gas container 12 to the liquified gas made the container, and namely, the heat energy is utilized effectively. Air which has passed inside of the enclosure 16 will then pass to the open air from the upper portion of the enclosure 16.

Although the preferred embodiments of the present invention have been described in detail above, obvious variations thereof will be readily apparent to the skill artisan. For instance, the internal structure of the mounting base 14 and the numbers of the through holes 42, 46, 48 can be properly modified. As to the means for supplying the heated air, in addition, it is not limited to the illustrated air fan heater 18.

Figure 5:
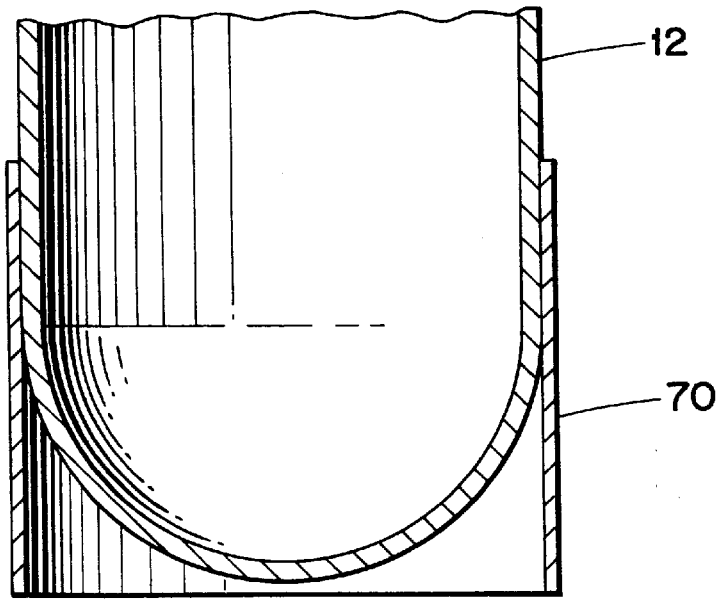
FIG. 5 is a cross-sectional view showing another gas container which can be used in the heating apparatus according to the present invention.

Since the present invention is constructed such that heated air is blasted onto the bottom face of a gas container, it is also applicable to other forms, such as that shown in FIG. 5, where the bottom face of a gas container is semi-spherically convex and said gas container has a skirt 70 for vertical placement.

According to the present invention, as has been mentioned above, it is possible to effectively heat a liquified gas filled in a gas container. Accordingly, such a problem becomes extinct that the gas supply pressure is remarkably lowered as said gas is being used.

Since heated air is generally used as the heating source in applying the present invention, the cost of the apparatus and its operation is quite economical. The amount of labor required for maintenance and management of the apparatus is also reduced because the handling of air is easy.

What is claimed is:

1. A heating apparatus for heating a liquified gas stored in a gas container, which comprises:

a mounting base having a mounting area on which a gas container is to be mounted, and a first space and a second space, each formed within the mounting base, and each independent of the other, with the mounting base having a first through hole communicating with said first space and second through holes communicating with said second space, the first and second through holes being inside of said mounting area, and third through holes communicating with said second space outside of said mounting area, and a heated air supply means for supplying heated air to said first space of said mounting base, whereby when a gas container is mounted in said mounting area of said mounting base, the heated air is blasted from said first space onto the bottom face of said gas container through said first through hole, and then introduced into said second space through said second through holes, and again led out of said third through holes to the outside of said mounting base.

2. The heating apparatus for a gas container according to claim 1, wherein the apparatus further comprises:

an enclosure for surrounding the outer face of the side wall of a gas container mounted in said mounting area, with a gap held between them, which is constructed such that the heated air led out of said third through holes is supplied to said gap.

3. A process for heating a gas container containing liquified gas, comprising mounting the container on the mounting base of the apparatus of claim 1, and then supplying heated air to the apparatus to effect heating of the gas container and its contents.

* * * * *